US009598819B2

(12) United States Patent
Barton

(10) Patent No.: US 9,598,819 B2
(45) Date of Patent: Mar. 21, 2017

(54) SURFACTANT BASED BROWN STOCK WASH AID TREATMENT FOR PAPERMACHINE DRAINAGE AND DRY STRENGTH AGENTS

(71) Applicant: SOLENIS TECHNOLOGIES, L.P., Schaffhausen (CH)

(72) Inventor: Iris D. Barton, Hockessin, DE (US)

(73) Assignee: Solenis Technologies, L.P. (CH)

( * ) Notice: Subject to any disclaimer, the term of this patent is extended or adjusted under 35 U.S.C. 154(b) by 230 days.

(21) Appl. No.: 14/535,692

(22) Filed: Nov. 7, 2014

(65) Prior Publication Data

US 2015/0129148 A1 May 14, 2015

Related U.S. Application Data

(60) Provisional application No. 61/901,552, filed on Nov. 8, 2013.

(51) Int. Cl.

| | |
|---|---|
| ***D21H 21/10*** | (2006.01) |
| ***D21H 21/18*** | (2006.01) |
| ***D21H 17/37*** | (2006.01) |
| ***D21H 17/45*** | (2006.01) |
| ***D21H 17/53*** | (2006.01) |
| ***D21H 17/55*** | (2006.01) |
| ***D21H 17/56*** | (2006.01) |
| ***D21H 21/24*** | (2006.01) |

(52) U.S. Cl.

CPC ..... *D21H 21/10* (2013.01); *D21H 17/37* (2013.01); *D21H 17/375* (2013.01); *D21H 17/45* (2013.01); *D21H 17/55* (2013.01); *D21H 17/56* (2013.01); *D21H 21/18* (2013.01); *D21H 21/24* (2013.01)

(58) Field of Classification Search

USPC ..... 164/158, 164.1, 164.2, 164.6, 166, 164/168.1–168.3, 183, 185

See application file for complete search history.

(56) References Cited

U.S. PATENT DOCUMENTS

| | | | | |
|---|---|---|---|---|
| 2,049,567 | A | 8/1936 | Larson et al. | |
| 2,072,487 | A | 3/1937 | Snyder | |
| 2,502,330 | A | 3/1950 | Libby | |
| 3,706,629 | A | 12/1972 | Moore et al. | |
| 4,135,969 | A | 1/1979 | Cosper | |
| 4,297,164 | A | 10/1981 | Lee | |
| 4,347,100 | A | 8/1982 | Brucato | |
| 4,533,434 | A | 8/1985 | Yoshioka et al. | |
| 4,810,328 | A | 3/1989 | Freis et al. | |
| 5,032,224 | A | 7/1991 | Ahluwalia | |
| 5,338,406 | A * | 8/1994 | Smith | D21H 17/32 162/164.1 |
| 5,405,498 | A | 4/1995 | Pease | |
| 5,464,502 | A | 11/1995 | Pease | |
| 5,496,440 | A | 3/1996 | Carre et al. | |
| 5,641,385 | A | 6/1997 | Croft et al. | |
| 6,083,348 | A * | 7/2000 | Auhorn | D21F 1/08 162/164.6 |
| 6,303,002 | B1 * | 10/2001 | Linhart | D21H 21/02 162/164.3 |
| 6,706,144 | B1 * | 3/2004 | Furman, Jr. | D21C 9/18 162/72 |
| 7,442,280 | B1 | 10/2008 | Klements et al. | |
| 2004/0118540 | A1 * | 6/2004 | Garnier | D21H 17/20 162/164.1 |
| 2013/0280508 | A1 | 10/2013 | Heinzman | |

FOREIGN PATENT DOCUMENTS

| | | |
|---|---|---|
| EP | 0631010 | 12/1994 |
| EP | 0709521 | 9/1995 |
| EP | 1433898 | 6/2004 |
| JP | 2009203579 | 9/2009 |
| WO | 9206241 | 4/1992 |
| WO | 0034582 | 6/2000 |
| WO | 2004052942 | 6/2004 |

OTHER PUBLICATIONS

Smook, Gary A., Handbook for Pulp and Paper Technologists, 2nd ed, Angus Wilde Publications, 1992, pp. 220.*

Tappi method T 222 om-02. Acid-insoluble lignin in wood and pulp, 2002, [online], retrieved from the Internet, [retrieved Aug. 17, 2016], <URL: https://research.cnr.ncsu.edu/wpsanalytical/documents/T222.PDF>.*

Aloi, Francis G., and R. M. Trksak. "Retention in neutral and alkaline papermaking." Retention of Fines and Fillers during Papermaking, TAPPI Press, see esp (1998): 80-97.

Laxen, T., "Dynamic and Physical-Chemical Aspects of Sulphate Pulp Washing", Pulp and Paper Canada 87(4):49-53 (1986).

Wilkes, et al., "New Surface Active Chemicals", Paper Trade Journal, Aug. 17, 1939, pp. 63-66.

Josephson, Wm E., et al., "Multi-component control of brownstock washing" vol. 76, No. 9 pp. 197-204, 1993.

International Search Report, PCT/US2014/064537. Mar. 2, 2015.

* cited by examiner

*Primary Examiner* — Dennis Cordray

(74) *Attorney, Agent, or Firm* — Joanne Rossi; Michael Herman

(57) ABSTRACT

A method of treating a cellulosic slurry to improve drainage is disclosed; the method comprises adding a surfactant based brown stock wash aid to a cellulosic furnish in an amount of from 0.5 to 1 lbs per ton and adding a synthetic polymer papermachine drainage or strength aid to the furnish in an amount of from 0.1 to 10 lbs per ton, allowing the furnish to drain and forming a paper product.

12 Claims, No Drawings

SURFACTANT BASED BROWN STOCK WASH AID TREATMENT FOR PAPERMACHINE DRAINAGE AND DRY STRENGTH AGENTS

This application claims the benefit of U.S. provisional application No. 61/901,522, filed Nov. 8, 2013, the entire contents of which are hereby incorporated by reference.

FIELD OF THE INVENTION

This invention relates to a method of treating an unbleached cellulosic slurry to improve performance of drainage aids or strength aids

BACKGROUND

Paper and paperboard are produced from an aqueous slurry of cellulosic fiber, depositing this slurry on a moving papermaking wire or fabric, and forming a sheet from the solid components of the slurry by draining the water. This sequence is followed by pressing and drying the sheet to further remove water.

Drainage or dewatering of the fibrous slurry on the papermaking wire or fabric is often the limiting step in achieving faster paper machine speeds. Improved dewatering can also result in a drier sheet in the press and dryer sections, resulting in reduced energy consumption. Chemicals are often added to the fibrous slurry before it reaches the papermaking wire or fabric to improve drainage/dewatering and solids retention; these chemicals are called papermachine retention and/or drainage aids.

Dry strength additives are used in paper mill to increase the strength of paper. It increases the strength of paper by increasing internal bond formation. Moreover dry strength additives improve bust strength, tear strength, wax pick values, folding endurance, stiffness, machine runnability, increase levels of paper filler uses etc. Dry strength additives also reduced linting and dusting. A drainage aid may also provide improved dry strength on a papermachine, where an increase in drainage is utilized to increase refining or dilute the headbox consistency, thus providing improved sheet strength properties.

Papermachine drainage aids have reduced efficacy in some furnish substrates which contain high levels of soluble organics and salts. Two such examples of these furnishes are neutral sulfite semi-chemical (NSSC) and kraft virgin linerboard, where high levels of soluble lignin and other organic materials containing a high anionic charge are present. These highly anionic materials neutralize the charge on the conventional drainage and dry strength aids, significantly reducing their effectiveness.

DESCRIPTION OF INVENTION

It has been discovered that use of surfactant based brown stock wash (BSW) aids will improve the performance of the papermachine drainage or strength agents in unbleached cellulosic furnish that contain high levels of soluble lignin, where the papermachine drainage or strength agents have reduced performance or are not active. High levels of soluble lignin in these cellulosic furnishes range from 25 ppm up to 2500 ppm. Surfactant based wash aids have not historically been used in unbleached pulp mill, but more often in bleached pulp mills to increase washing and cleanliness of brown cellulosic furnish going into a bleach plant, resulting in a lower use rate of bleaching chemicals to reach their target paper brightness. Examples of surfactant based wash aids for bleached mills are taught in U.S. Pat. No. 5,405,498 and U.S. Pat. No. 5,404,502.

The invention provides for a method of treating a cellulosic slurry to improve drainage, the method comprising adding a surfactant based brown stock wash aid to an unbleached cellulosic furnish in an amount of from 0.1 to 10 lbs per ton and adding a synthetic polymer papermachine drainage or strength aid to the furnish in an amount of from 0.1 to 10 lbs per ton, allowing the furnish to drain and forming an unbleached paper product.

For this invention surfactant based brown stock wash aids are different from defoamer drainage aids, although these technologies are sometimes both referred to as brown stock wash aids. For purposes of this invention the defoamer drainage aids are not included in surfactant based brown stock wash aids. Defoamer drainage aids normally contain silicone (polymethyl siloxane) oils, silicone surfactant, aliphatic hydrocarbon oils and particulates. The particles can be comprised of precipitated or fumed silica or ethylene bis stearamide (EBS). The defoamer drainage aid mechanism is to reduce entrained air by rupturing bubbles that impede drainage, resulting in increased drainage. The defoamer drainage aids can be applied in the pulp mill on washers or in screen rooms, or also on a papermachine. In all these instances, the defoamer drainage aid acts to increase the rate of pulp dewatering by removing entrained air. Defoamer drainage aids are blends of silicone oil and/or surfactants, hydrocarbon oil, and particles, which function to remove entrained air, thus improving pulp dewatering.

For the present invention, surfactant based brown stock wash aids are blends of non-ionic and anionic surfactants which stabilize and remove lignin. Surfactant based brown stock wash aids ("surfactant based BSW aid(s)") are typically blends of non-ionic and anionic surfactants. The anionic surfactant of the surfactant based BSW aid stabilize the resins and lignin, keeping them small, discreet and colloidal. The nonionic surfactant component reduces the surface tension, resulting in increased drainage, while removing more of the colloidal material with it. The surfactant based brown stock wash aids will in turn decrease the lignin content of the cellulosic slurry. The surfactant based brown stock wash aids have not been previously known to be utilized in unbleached pulp mills.

Surfactant based brown stock wash aids are typically blends of non-ionic and anionic surfactants. Examples of non-ionic surfactants include nonyl phenol ethoxylates; linear and branched alcohol alkoxylates; sorbitan esters; alkoxylated sorbitan alkyl esters; and di-block and tri-block copolymers of polyethylene glycol and polypropylene glycol. The hydrophile-lipophile balance (HLB) of the non-ionic surfactant will range from 7-20, preferably 10-20, and more preferably 12-16. Examples of anionic surfactants or dispersants include alkylbenzene sulfonates, dialkyl sulfosuccinates, alkyl sulfonates, alkyl phosphates, alkyl carboxylates, where the alkyl chain can be linear or branched; poly(meth)acrylates; poly maleic acid and anhydrides; and lignosulfonates. Specific examples of surfactant based BSW aids include Infinity PK2735, Infinity PK2732 and Infinity 2726 (Hercules Incorporated, Wilmington Del.), which are blends of anionic and non-ionic surfactants. The weight ratio of non-ionic to anionic surfactants can be from 1:99 to 99:1 or from 5:95 to 95:5 or from 10:90 to 90:10 or from 20:80 to 80:20.

Without wishing to be bound by theory, it is believed that the anionic surfactant of the surfactant based BSW aids stabilize the resins and lignin, keeping them small, discreet and colloidal. The nonionic surfactant reduces the surface tension, resulting in increased drainage, while removing more of the colloidal material with it. The surfactant based brown stock wash aids will decrease the lignin content of the cellulosic slurry. The reduced lignin content will result in increased effectiveness of the conventional drainage and dry strength agents.

Surfactant based BSW aids are added in the washer line in the pulp mill, where the objective of the washers is to remove and recover the components of the cooking liquor. The surfactant based BSW aid can be added to the dilution water, utilized to dilute the pulp from 8-10% concentration to 1 to 3% concentration prior to the washer. The surfactant based BSW aid can also be added to the shower water which is applied to the pulp mat on the washer.

The surfactant based BSW aid treatment dosage is started low and increased slowly over a period of time, usually several days. The BSW aid dosage can range from 0.01 to 10 lb., or 0.05 to 5 lb., or 0.2 to 1 lb. of BSW aid per ton of furnish solids. The BSW aid is generally supplied as liquid requiring no secondary dilution.

The papermachine drainage aids or strength aids which will function, in unbleached grades of paper products due to the surfactant based BSW aid treatment, are generally water-soluble or water-dispersible synthetic polymers. The synthetic polymer papermachine strength aids or drainage aids can be nonionic polymers, cationic copolymers or anionic copolymers.

In general papermachine drainage aids function by a combination of coagulation and/or flocculation mechanisms, which in turn flocculate the pulp slurry. Coagulation is the process of destabilization by charge neutralization. Once neutralized, particles or fibers no longer repel each other and can be brought together. Coagulation is typically accomplished with coagulants, which have a low molecular weight of 500,000 grams per mole or less, a charge density of 2 to 20 milliequivalents per gram organic polyelectrolyte, or inorganic materials, such as aluminum sulfate or ferric chloride. Flocculation is the process of bringing together the destabilized, coagulated particles or fibers via a bridging method to form a larger agglomeration or floc. Flocculation is typically accomplished with a papermachine drainage aid such as a polymeric flocculant, which are typically high molecular weight of 2 million g/mole or higher polyacrylamides or polyethylene oxide. The larger agglomerate of pulp will then allow the water to drain more freely from the forming cellulose pulp pad, thus increasing the drainage or dewatering rate.

For the present invention, papermachine drainage aids are those that function by a coagulation and flocculation mechanism to produce a macro-aggregate of fibers, which in turn increase the rate of pulp dewatering. These are different in composition and mechanism from defoamer drainage aids, which are silicone based and function by destabilizing and disrupting air bubbles attached to the fibers, which allows the pulp to dewater faster.

The synthetic polymer papermachine strength aids or drainage aids can be nonionic polymers, cationic copolymers or anionic copolymers.

The nonionic monomers used to make the synthetic polymer papermachine drainage or strength aids include, but are not limited to, acrylamide; methacrylamide; N-alkylacrylamides, such as N-methylacrylamide; N,N-dialkylacrylamide, such as N,N-dimethylacrylamide; methyl methacrylate; methyl acrylate; acrylonitrile; N-vinyl methylacetamide; N-vinylformamide; N-vinylmethyl formamide; vinyl acetate; N-vinyl pyrrolidone and mixtures of any of the foregoing. The invention contemplates that other types of nonionic monomer can be used. More than one kind of non-ionic monomer can be used to make the synthetic polymer. Preferable nonionic monomers used are acrylamide; methacrylamide, N-vinylformamide The cationic monomers used to make the synthetic polymer papermachine drainage or strength aids include, but are not limited to, cationic ethylenically unsaturated monomers such as the diallyldialkylammonium halides, such as diallyldimethylammonium chloride; the (meth)acrylates of dialkylaminoalkyl compounds, such as dimethylaminoethyl (meth)acrylate, diethylaminoethyl (meth)acrylate, dimethyl aminopropyl (meth)acrylate, 2-hydroxydimethyl aminopropyl (meth)acrylate, aminoethyl (meth)acrylate, and the salts and quaternaries thereof; the N,N-dialkylaminoalkyl(meth) acrylamides, such as N,N-dimethyl aminoethyl (meth)acrylamide, and the salt and quaternaries thereof and mixtures of the foregoing. More than one kind of cationic monomer can be used to make the synthetic polymer. Most preferred are diallyldimethylammonium chloride and dimethylaminoethyl (meth)acrylate and the salt and quaternaries thereof and mixtures of the foregoing.

Poly(vinylamine) is also a suitable cationic synthetic polymer for the invention as a papermachine drainage or strength aid. The polyvinyl amine can be a homopolymer or a copolymer. One method of producing a polyvinylamine polymer is by polymerization of the monomer(s) followed by hydrolysis. The level of hydrolysis can be expressed as "% hydrolysis" or "hydrolysis %" on a molar basis. A hydrolyzed polymer can thus be described by as "% hydrolyzed." Moreover the level of hydrolysis can be approximated. For the purposes of applicants' invention, a poly (vinylamine) that is referred to as "50% hydrolyzed" means from 40 to 60% hydrolyzed. Likewise, a poly(vinylamine) that is about 100% hydrolyzed means from 80 to 100% hydrolyzed. The hydrolysis reaction results in the conversion of some or all of the monomer(s) to amines, as controlling the hydrolysis reaction can vary the resultant percentage of monomers having amine functionality. The level of hydrolysis can range from 10% to 100%, or 20% to 100%, or more preferably 30% to 100%.

Examples of monomers used to make a poly(vinylamine) include, but are not limited to, N-vinylformamide, N-vinyl methyl formamide, N-vinylphthalimide, N-vinylsuccinimide, N-vinyl-t-butylcarbamate, N-vinylacetamide, and mixtures of any of the foregoing. Most preferred are polymer prepared by the hydrolysis of N-vinylformamide. In the case of copolymers, nonionic monomers, such as those described above, are the preferred comonomers. Alternatively, poly (vinylamine) can be prepared by the derivatization of a polymer. Examples of this process include, but are not limited to, the Hofmann reaction of polyacrylamide. It is contemplated that other synthetic routes to a poly(vinylamine) or polyamine can be utilized.

The molar percentage of nonionic monomer to cationic monomers may fall within the range of about 100:1 to 1:100, or 80:20 to 20 to 80, or 75:25:25:75 or 40:60 to 60:40. The molar percentages of nonionic monomers to cationic monomers can add up to 100%. It is to be understood that more than one kind of nonionic or cationic monomer may be present in synthetic polymer drainage or strength aid. Examples of cationic copolymers can include polymers with acrylamide; methacrylamide or N-vinylformamide in combination with cationic monomers such as diallyldimethylammonium chloride or dimethylaminoethyl (meth)acrylate.

The anionic monomers used to make the synthetic polymer papermachine drainage or strength aids include, but are not limited to, the free acids and salts of acrylic acid; methacrylic acid; maleic acid; itaconic acid; acrylamidoglycolic acid; 2-acrylamido-2-methyl-1-propanesulfonic acid; 3-allyloxy-2-hydroxy-1-propanesulfonic acid; styrenesulfonic acid; vinylsulfonic acid; vinylphosphonic acid; 2-acrylamido-2-methylpropane phosphonic acid; and mixtures of any of the foregoing. Most common are the free acids or salts of acrylic acid, methacrylic acid, and 2-acrylamido-2-methyl-1-propanesulfonic acid. When a salt form of an acid is used to make an anionic polymer, the salt is selected from $Na^+$, $K^+$ or $NH_4^+$. More than one kind of anionic monomer can be used to make the synthetic polymer.

The molar percentage of nonionic monomers to anionic monomers may fall within the range of about 100:1 to 1:100, or 90:10 to 30:70, or 70:30 to 40:60, where the molar percentages of nonionic monomers to anionic monomers may add up to 100%. It is to be understood that more than one kind of nonionic may be present. It is to be understood that more than one kind of anionic monomer may be present. Examples of anionic copolymers can include polymers comprising acrylamide; methacrylamide or N-vinylformamide in combination with anionic monomers such as acrylic acid or methacrylic acid.

It is also understood that the synthetic polymer drainage or strength aid may contain, in addition to one or more non-ionic monomers, one or more of both cationic and anionic monomers, resulting in an amphoteric polymer. The molar percentage of cationic monomers to anionic monomers may fall within the range of about 100:1 to 1:100, or 90:10 to 10:90, or 40:60 to 60:40, where the molar ratios of non-ionic, anionic, and cationic monomers must add up to 100%.

The synthetic water-soluble or water-dispersible polymer papermachine drainage or strength aids can also be modified to impart additional properties to the synthetic polymer or to modify the synthetic polymer structure. Polymerization of the monomers can occur in the presence of a polyfunctional agent, or the polyfunctional agent can be utilized to treat the polymer post-polymerization. Useful polyfunctional agents comprise compounds having either at least two double bounds, a double bond and a reactive group, or two reactive groups. Illustrative of those containing at least two double bounds are N,N-methylenebisacrylamide; N,N-methylenebismethacrylamide; polyethylene glycol diacrylate; polyethylene glycol dimethacrylate; N-vinyl acrylamide; divinylbenzene; triallylammonium salts, and N-methylallylacrylamide. Polyfunctional branching agents containing at least one double bond and at least one reactive group include glycidyl acrylate; glycidyl methacrylate; acrolein; and methylolacrylamide. Polyfunctional branching agents containing at least two reactive groups include dialdehydes, such as glyoxal; and diepoxy compounds; epichlorohydrin.

Additional examples of synthetic polymers papermachine drainage aids used in the invention include but are not limited to polyvinylamine, glyoxylated cationic polyacrylamide, and cationic polyacrylamide. Preferred are 100% hydrolyzed polyvinylamine, 50% hydrolyzed polyvinylamine and cationic polyacrylamide containing up to 30 mole % cationic monomer. One example would be cationic polyacrylamide containing up to 50 mole % diallyldimethylammonium chloride or up to 30 mole % dimethylaminoethyl (meth)acrylate. Additional useful polymers of the present invention include Perform™ products such as SP 7200 (anionic polyacrylamide polymer), Hercobond™ 6350 (polyvinylamine copolymer polymer), Hercobond™ 6363 (polyvinylamine copolymer), Hercobond™ 6950 (polyvinylamine copolymer), Hercobond™ 1307 (modified cationic polyacrylamide), Perform™ PC 8181 (cationic polyacrylamide), Perform™ PC 8179 (cationic polyacrylamide) all available from Hercules Incorporated, Wilmington, Del.).

The molecular weight of the non-ionic, cationic, or anionic polymer papermachine drainage or strength aids can range from a viscosity average molecular weight of 100,000 to 50,000,000 Daltons, or 1,000,000 to 25,000,000, or 5,000,000 to 20,000,000.

The treatment is effectuated by adding the surfactant based BSW aid to dilution or shower water in the pulp mill, in order to washout and remove the lignin. Surfactant based BSW aid feed rates are started low, and ramped up slowly over time, generally several days, to reach a critical micelle concentration (CMC), which then provides a performance response. The dosage is slowly increased over time in order to prevent an overfeed of the surfactant based wash aid, which would result in too rapid drainage and sealing of the fibrous mat on the pulp drum. The filtrate conductivity and lignin content, the fiber mat consistency, and the ease of removing the pulp off the drum via a doctor blade are monitored to determine the activity of the surfactant based wash aid, and also to prevent an overfeed situation. As the CMC is reached there is an increase in consistency of the pulp. Also the average conductivity in the filtrate as measured over a period of hours will have a step increase when the CMC is reached. A person of skill in the art would be able to determine when the CMC is reached. After cycle up of the surfactant based BSW aid has been achieved and the levels of lignin are reduced, the water-soluble or water-dispersible synthetic polymer papermachine drainage aids are added to the treated slurry closer to the papermachine. The slurry is then drained on the papermaking wire to dewater the fibrous slurry and to form a sheet. Improved drainage is observed when the surfactant based BSW aid and the synthetic polymer papermachine drainage aids are used in conjunction with one another.

One location where the brown stock wash aid can be added is at the last stage brown stock washer.

It has been discovered that less synthetic polymer papermachine drainage aid can be used while still maintaining the same performance level (drainage) when the surfactant based BSW aid is used in conjunction with the synthetic polymer papermachine drainage aids. Alternatively, in some papermaking systems where the synthetic polymer papermachine drainage aid is mostly ineffective, the use of a surfactant based BSW aid will provide efficiency of the synthetic polymer papermachine drainage aid.

The feed point of the synthetic polymer papermachine drainage aid are those well know in the art and can include the thick stock or thin stock, blend chest, machine chest, fan pump, cleaners, and before or after the centriscreen. The synthetic polymer papermachine drainage aid dosage can range from 0.01 lbs to 10 lbs. of active polymer per ton of furnish solids or 0.01 to 5, or 0.05 to 5, or 0.1 to 2 lbs. of polymer per ton of furnish solids. The synthetic polymer papermachine drainage aid can be manufactured and supplied to the end user as a dry or granular powder, an aqueous solution or dispersion, or an inverse emulsion.

The weight ratio of the surfactant based BSW aid to synthetic water-soluble polymer papermachine drainage aid can range from 100:1 to 1:100 or 80:20 to 20:80 or 50:50 to 10:90 or 60:40 to 40:60.

Suitable cellulosic furnish or fiber pulps for the method of the invention include conventional papermaking stock such as traditional chemical pulp. For instance, unbleached kraft, sulfate pulp and sulfite pulp, mechanical pulp such as groundwood, thermomechanical pulp, or chemi-thermomechanical pulp. The pH of the cellulosic furnish or slurry may range from 4 to 10.

This invention is used to make paper products in which the pulp has not been through a bleaching process.

In one embodiment of the invention an unbleached cellulosic slurry is treated to improve drainage, the treatment comprising adding a surfactant based brown stock wash aid to the cellulosic furnish in an amount of from 0.1 to 10 lbs per ton, and adding a synthetic polymer papermachine drainage or strength aid to the cellulosic furnish in an amount of from 0.1 to 10 lbs per ton, allowing the cellulosic furnish to drain and forming an unbleached paper product.

In one embodiment of the invention an unbleached cellulosic slurry is treated to improve drainage, the treatment comprising adding a defoamer to an unbleached cellulosic furnish in an amount from 0.1 to 10 lbs per ton, and adding a surfactant based brown stock wash aid to the cellulosic furnish in an amount of from 0.1 to 10 lbs per ton, and adding a synthetic polymer papermachine drainage or strength aid to the cellulosic furnish in an amount of from 0.1 to 10 lbs per ton, allowing the cellulosic furnish to drain and forming an unbleached paper product.

In one embodiment of the invention an unbleached cellulosic slurry is treated to improve drainage, the treatment comprising adding a surfactant based brown stock wash aid comprising 5 to 30% by weight of a triblock copolymer of polyethylene glycol and poly propylene glycol, 5 to 40% by weight of an alcohol ethoxylate, and 2 to 20% by weight of a copolymer of polyisobutylene and sodium polymaleate to the cellulosic furnish in an amount of from 0.1 to 2 lbs per ton and adding a 10 mole percent charge cationic polyacrylamide papermachine drainage or strength aid to the cellulosic furnish in an amount of from 0.1 to 2 lbs per ton, allowing the cellulosic furnish to drain and forming an unbleached paper product.

Preferred products and dosages for the invention are: from 0.5 to 1.51 b./T of Infinity PK2735 plus from 1 to 4 lb./T active Hercobond 6950; from 0.5 to 1.5 lb./T of Infinity PK2735 plus from 1 to 4 lb./T active Hercobond 1307; from 0.5 to 1.5 lb./T of Infinity PK2735 plus 0.1 to 2 lb./T as product Perform PC 8179; from 0.5 to 1.5 lb./T of Infinity PK2735 r plus 0.1 to 2 lb./T as product Perform PC 8181.

EXAMPLES

Example 1

A series of drainage experiments were conducted to demonstrate the negative effect of soluble lignin on synthetic polymer papermachine drainage aids. An unbleached softwood kraft pulp from a southern US linerboard papermachine was obtained. The furnish consistency was adjusted to 0.5% consistency with deionized water. The furnish conductivity was adjusted to 2500 μS/cm using 0.15% of anhydrous sodium sulfate. The pH was adjusted to 5.0 using concentrated sulfuric acid.

The drainage activity of the invention was determined utilizing a modification of the Dynamic Drainage Analyzer, test equipment available from AB Akribi Kemikonsulter, Sundsvall, Sweden. The test device applies a 300 mbar vacuum to the bottom of the separation medium for a total time of 60 seconds. The device electronically measures the time between the application of vacuum and the vacuum break point, i.e. —the time at which the air/water interface passes through the thickening fiber mat. It reports this value as the drainage time. A lower drainage time is preferred. The modification consists of substituting a mixing chamber and filtration medium with both smaller sample volume and cross-sectional area to the machine. A 250-ml sample volume at 0.5% consistency and a 47-mm cross-sectional filtration diameter (60-mesh screen) were used for all tests.

The drainage tests were conducted with 0.5 lb of PerForm® PC920 cationic polyacrylamide drainage aid (Hercules Incorporated, Wilmington, Del.) per ton of furnish. Next increasing levels of soluble kraft lignin (Indulin AT, MeadWestvaco, Charlotte, N.C.) were added to the furnish and the drainage properties were evaluated.

TABLE 1

| Polymer | #/T | Lignin, ppm | Drain Time, s |
|---|---|---|---|
| Blank | 0 | 0 | 77.7 |
| PC 920 | 0.5 | 0 | 58.6 |
| PC 920 | 1 | 0 | 58.2 |
| PC 920 | 0.5 | 50 | 84.5 |
| PC 920 | 1.0 | 50 | 108.6 |
| PC 920 | 0.5 | 100 | 177.9 |
| PC 920 | 1 | 100 | 309.1 |

As shown in Table 1, increased levels of soluble lignin provide a dramatic decrease in the drainage performance of the cationic polymer. Thus if the level of soluble lignin could be reduced, such as in the inventive process by the use of a surfactant based brown stock wash aid, the performance of the cationic polymer could be maintained or improved.

Example 2

A second series of drainage experiments were conducted to demonstrate the negative effect of soluble lignin on synthetic polymer papermachine drainage aids. An unbleached softwood kraft pulp from a southern US linerboard papermachine was obtained. The furnish consistency was adjusted to 0.7% consistency by blending machine chest stock and white water. The furnish conductivity was 1830 μS/cm and the pH was 5.0.

The drainage activity of the invention was determined utilizing a Dynamic Drainage Analyzer as described in example 1 with the following test procedure revisions. The DA was equipped with the standard instrument mixing chamber and 500 mls of stock were utilized. The drainage time as displayed by the instrument was recorded. The percent consistency of the pad after vacuum completion was also determined as another means to quantify the dewatering of the pulp pad. The resultant pad from the drainage test was removed from the DDA and weighed on a three place balance, then placed into a 125 C oven for 2 hours and reweighed. The percent consistency was calculated by dividing the wet pad weight by the final pad weight. A higher pad consistency is desired, and indicates a better dewatering response.

The drainage tests were conducted with 2 lb of Hercobond® 6950 cationic polyvinylamine drainage aid (Hercules Incorporated, Wilmington, Del.) per ton of furnish. Next increasing levels of soluble kraft lignin (Indulin C, MeadWestvaco, Charlotte, N.C.) were added to the furnish and the drainage properties were evaluated.

TABLE 2

| Polymer | #/T (active) | Lignin, ppm | Drain Time, s | Pad Consistency, % |
|---|---|---|---|---|
| Blank | 0 | 0 | 24.6 | 16.1 |
| Hercobond 6950 | 2 | 0 | 20.1 | 16.4 |
| Blank | 0 | 100 | 30.3 | 14.7 |
| Hercobond 6950 | 2 | 100 | 22.7 | 16.0 |
| Blank | 0 | 200 | 34.4 | 13.9 |
| Hercobond 6950 | 2 | 200 | 27.3 | 15.2 |
| Blank | 0 | 400 | 45.0 | 10.4 |
| Hercobond 6950 | 2 | 400 | 42.9 | 12.4 |

As shown in Table 2, increased levels of soluble lignin provide a dramatic decrease in the drainage properties of the untreated stock and the drainage performance of the cationic polymer. The drainage times become slower and the pad becomes wetter with increased levels of soluble lignin. The data demonstrate that if the level of soluble lignin could be reduced, as in the inventive process by the use of a surfactant based brown stock wash aid, the drainage and dewatering properties of the stock, and the drainage and dewatering performance of the cationic polymer, could be maintained or improved.

Example 3

Prophetic Example

In a southern virgin linerboard mill, 1 lb./T of Infinity™ PK 2735 surfactant wash aid is added to the last stage of the brown stock washer line, The wash aid is slowly increased over time in 0.25 lb./T increments every 2 hours, such that the desired 1 lb./T dosage is achieved after 8 hours. The soluble lignin levels at the last washer line and headbox are monitored using a portable UV spectrophotometer at 280 nm wavelength. After one week the soluble lignin levels are expected to be reduced by 50% due to the increased washing efficiency provided by feeding surfactant wash aid. Once the lower lignin levels are achieved, Hercobond™ 6950 polyvinylamine drainage aid is added to the thin stock after the pressure screen at a dosage of 2 lb./T active polymer. The drainage aid is slowly increased over time in 0.5 lb./T increments every 6 hours, such that the desired 2 lb./T dosage is achieved after 24 hours. Once the target dosage is achieved, it is expected that the papermachine couch solids increases, and the steam usage decreases, allowing the papermachine speed to increase by 10%. Paper product is formed.

Example 4

Prophetic Example

A southern virgin linerboard mill is feeding Hercobond™ 6950 polyvinylamine drainage aid to the thin stock after the pressure screen at a dosage of 2 lb./T active polymer. The drainage performance is highly inconsistent, as the couch consistency varies by +/−2%, resulting in wide swings in machine speed of +/−10%. The soluble lignin levels are monitored at the last washer line and headbox using a portable UV spectrophotometer at 280 nm wavelength, with an average value of 350 ppm and a relative standard deviation (RSD) of 30%. 1 lb./T of Infinity™ PK 2735 wash aid is added to the last stage of the brown stock washer to reduce the soluble lignin and to minimize the variation. The wash aid is increased over time in 0.25 lb./T increments every 2 hours, such that the desired 1 lb./T dosage is achieved after 8 hours. After one week the soluble lignin levels is expected to be reduced by to an average of 150 ppm, and the RSD is expected to be less than 10%. The performance of the drainage aid is also improved, as the papermachine couch solids increase, and the steam usage decreases, allowing the papermachine speed to increase by 10%. Paper product is formed.

Example 5

Prophetic Example

In a southern virgin linerboard mill, 1 lb./T of Infinity™ PK 2735 surfactant wash aid is added to the last stage of the brown stock washer line. The wash aid is slowly increased over time in 0.25 lb./T increments every 2 hours, such that the desired 1 lb./T dosage is achieved after 8 hours. The soluble lignin levels at the last washer line and headbox are monitored using a portable UV spectrophotometer at 280 nm wavelength. After one week the soluble lignin levels are expected to be reduced by 50% due to the increased washing efficiency provided by feeding surfactant wash aid. Once the lower lignin levels are achieved, Perform™ PC 8179 drainage aid is added to the thin stock after the pressure screen at a dosage of 1 lb./T active polymer. The drainage aid is slowly increase over time in 0.25 lb./T increments every 6 hours, such that the desired 1 lb./T dosage is achieved after 24 hours. Once the target dosage is achieved, it is expected that the papermachine couch solids increases, and the steam usage decreases, allowing the papermachine speed to increase by 10%. Paper product is formed.

The invention claimed is:

1. A method of treating an unbleached cellulosic furnish to improve drainage comprising adding a surfactant based brown stock wash aid comprising 5 to 30% of a triblock copolymer of polyethylene glycol and poly propylene glycol, 5 to 40% of an alcohol ethoxylate, and 2 to 20% of a copolymer of polyisobutylene and sodium polymaleate to the cellulosic furnish in an amount of from 0.01 to 10 lbs per ton of furnish solids and adding a cationic polyacrylamide papermachine drainage or strength aid to the cellulosic furnish in an amount of from 0.01 to 10 lbs per ton of furnish solids, allowing the cellulosic furnish to drain and forming an unbleached paper product.

2. The method of claim 1 wherein the synthetic polymer papermachine drainage or strength aid has a viscosity average molecular weight of 1,000,000 to 25,000,000 Daltons.

3. The method of claim 1 wherein the synthetic polymer papermachine drainage or strength aid has a viscosity average molecular weight of 500,000 to 5,000,000 Daltons.

4. The method of claim 1 wherein the cationic polymer is made using at least one cationic monomer selected from the group consisting of diallyldialkylammonium halides; the (meth)acrylates of dialkylaminoalkyl compounds and the salts and quaternaries thereof; the N,N-dialkylaminoalkyl (meth)acrylamides and the salt and quaternaries thereof and mixtures of the foregoing.

5. The method of claim 1 wherein the weight ratio of the surfactant based brown stock wash aid to synthetic polymer papermachine drainage or strength aid is in the range of from 80:20 to 20:80.

6. The method of claim 1 wherein amount of synthetic polymer papermachine drainage or strength aid added to the furnish is from 0.05 to 5 lbs of synthetic polymer per ton of furnish solids.

7. The method of claim 1 wherein the cellulosic furnish has a soluble lignin level of from 25 ppm up to 2500 ppm.

8. The method of claim 1 wherein amount of surfactant based brown stock wash aid added is from 0.1 to 2 lbs solids per ton of furnish solids.

9. The method of claim 1 wherein the cationic polymer is made using at least one cationic monomer selected from the group consisting of diallyldimethylammonium chloride; dimethylaminoethyl (meth)acrylate, diethylaminoethyl (meth)acrylate, dimethyl aminopropyl (meth)acrylate, 2-hydroxydimethyl aminopropyl (meth)acrylate, aminoethyl (meth)acrylate, and the salts and quaternaries thereof; N,N-dimethylaminoethyl acrylamide, and the salt and quaternaries thereof and mixtures of the foregoing.

10. The method of claim 1 wherein amount of surfactant based brown stock wash aid added is from 0.05 to 5 lbs solids per ton of furnish solids.

11. A method of treating an unbleached cellulosic furnish comprising adding a surfactant based brown stock wash aid to an unbleached cellulosic furnish in an amount of from 0.1 to 10 lbs per ton and adding a synthetic polymer papermachine drainage or strength aid to the furnish in an amount of from 0.1 to 10 lbs per ton furnish solid allowing the furnish to drain and forming an unbleached paper product, wherein the brown stock wash comprises at least one anionic surfactant and at least one nonionic surfactant, and di-block and tri-block copolymers of polyethylene glycol and polypropylene glycol, wherein the anionic surfactant is selected from the group consisting of alkylbenzene sulfonates, dialkyl sulfosuccinates, alkyl sulfonates, alkyl phosphates, alkyl carboxylates, where the alkyl chain can be linear or branched; "poly(meth) acrylates; polymaleic acid and anhydrides; and lignosulfonates; and wherein the at least one non ionic surfactant is selected from the group consisting of nonyl phenol ethoxylates; linear and branched alcohol alkoxylates; sorbitan esters; alkoxylated sorbitan alkyl esters; and wherein the weight ratio of the nonionic surfactant to the anionic surfactant is from 5:95 to 95:5.

12. A method of treating an unbleached cellulosic furnish comprising adding a surfactant based brown stock wash aid to an unbleached cellulosic furnish in an amount of from 0.1 to 10 lbs per ton and adding a synthetic polymer papermachine drainage or strength aid to the furnish in an amount of from 0.1 to 10 lbs per ton furnish solid allowing the furnish to drain and forming an unbleached paper product, wherein the brown stock wash comprises at least one anionic surfactant, at least one nonionic surfactant, and at least one surfactant formed from a polymaleic acid and an anhydride, wherein the anionic surfactant is selected from the group consisting of alkylbenzene sulfonates, dialkyl sulfosuccinates, alkyl sulfonates, alkyl phosphates, alkyl carboxylates, where the alkyl chain can be linear or branched; "poly(meth)acrylates; and lignosulfonates; and wherein the at least one non ionic surfactant is selected from the group consisting of nonyl phenol ethoxylates; linear and branched alcohol alkoxylates; sorbitan esters; alkoxylated sorbitan alkyl esters; di-block or tri-block copolymers of polyethylene glycol and polypropylene glycol; and wherein the weight ratio of the nonionic surfactant to the anionic surfactant is from 1:99 to 99:1.

* * * * *